United States Patent [19]

Irwin

[11] Patent Number: 5,069,345

[45] Date of Patent: Dec. 3, 1991

[54] PLASTIC CONTAINER WITH TEAR OPENING FEATURE

[75] Inventor: Christopher Irwin, Adrian, Mich.

[73] Assignee: Hoover Universal, Inc., Plymouth, Mich.

[21] Appl. No.: 587,085

[22] Filed: Sep. 24, 1990

[51] Int. Cl.[5] ..... B65D 41/32

[52] U.S. Cl. ..... 220/270; 215/255

[58] Field of Search ..... 206/601, 605, 607–609, 206/612, 613, 615, 634; 215/254–256

[56] References Cited

U.S. PATENT DOCUMENTS

| | | | |
|---|---|---|---|
| 3,368,707 | 2/1968 | Johnson et al. | 215/254 |
| 3,836,039 | 9/1974 | Seiferth et al. | 206/612 |
| 3,933,264 | 1/1976 | Rossi | 215/254 |
| 3,985,255 | 10/1976 | Blair | 215/254 |
| 4,207,988 | 6/1980 | Prouty | 215/256 |
| 4,502,608 | 3/1985 | Mills | 215/254 |
| 4,522,308 | 6/1985 | Sullivan | 215/256 |
| 4,595,123 | 6/1986 | Libit | 215/256 |
| 4,706,837 | 11/1987 | Cooke | 215/254 |
| 4,762,234 | 8/1988 | Croce | 206/634 |
| 4,768,667 | 9/1988 | Magnusson | 215/255 |

FOREIGN PATENT DOCUMENTS

| | | | |
|---|---|---|---|
| 2738551 | 3/1978 | Fed. Rep. of Germany | 215/254 |
| 2029381 | 3/1980 | United Kingdom | 215/254 |

*Primary Examiner*—Jimmy G. Foster

*Attorney, Agent, or Firm*—Harness, Dickey & Pierce

[57] ABSTRACT

A single service container having a plastic body and a non-removable plastic cap. The cap and body are made of materials which are compatible to one another for recycling purposes. A tear strip is defined in the cap by a pair of score lines which extend substantially across the cap. By lifting a pulling member that is integrally formed with the tear strip, the tear strip separates from the remainder of the cap along the score lines and provides the container with an opening through which its contents may be consumed. In this manner, a container is provided which has no components that need to be separated prior to recycling.

6 Claims, 4 Drawing Sheets

PLASTIC CONTAINER WITH TEAR OPENING FEATURE

BACKGROUND AND SUMMARY OF THE INVENTION

The present invention relates to a single serving container including a bottle and a cap with a tear opening feature. In particular, the cap is securely attached to the bottle and both the cap and bottle are made from a plastic material to simplify recycling of the container. Once attached, the cap is designed to remain on the bottle.

Containers having bottle caps with "tear-type" openings can be found in various known forms. One such cap is the tear-off cap. By tearing a strip of the cap, the cap becomes removable from the bottle, either partially or wholly. Tear-off caps are available wherein a pulling member and cap are constructed in two parts, the cap portion being made of metal while the pulling member is made of metal or plastic. Also available are tear-off caps where the pulling member and cap are manufactured from one piece of metal.

However, containers incorporating caps having the above described features all exhibit limitations. One drawback is the separation of the cap from the bottle, which increases the possibility that the cap will be inadvertently discarded as litter. Another drawback is its recyclability. Often times, the tear-off cap is made of materials that are incompatible for recycling purposes, such as metal and plastic. Meanwhile, the bottle itself may be made of a third material. Often, the different materials used in the construction of the container require complicated separation techniques either during or prior to recycling. This is both time consuming and costly. The alternative would be to forego recycling all together.

A "tear-open" container, as opposed to a "tear-off" container, is beneficial in that the necessity of removing the cap from the bottle prior to the consumption of the enclosed beverage or product is eliminated. Since the torn portion remains attached to the container, there is a decreased possibility of the cap or tab being disposed of in an irresponsible manner. This is beneficial from both an environmental and safety standpoint. However, such tear-open containers have been typically constructed of metal.

Therefore, an object of the present invention is to produce a low cost, single serving, plastic container in which the above mentioned drawbacks are eliminated.

Another object of the invention is to produce a plastic container with a cap having a tear opening feature.

An additional object of the invention is to produce a plastic container wherein the bottle and cap are made of a common material to thereby simplify the recycling process.

According to the invention, a plastic container having a tear-open cap may now be produced wherein the cap and the bottle are made from the same material. Thus, entire container may now be unitarily disposed of for recycling.

The container of the present invention is a single service container for beverages which includes an upright hollow body having a mouth formed at its upper end. A cap with a tear opening feature is mounted to the body at the mouth. The cap and the hollow body are constructed out of compatible recyclable materials, in particular, plastic. The cap is provided with a gasketing material on its lower surface which forms a seal around the mouth and further assists in retaining the beverage within the container. The cap is also provided with structures for securing it to the body, preventing its removal and causing the gasketing material to engage and seal container.

The tear open feature is defined in the cap as a tear strip which extends substantially across the opening formed by the mouth. The tear strip itself is defined by a pair of grooves or score lines formed in the cap. To open the tear strip, a pulling member is integrally provided therewith.

Upon the application of force on the pulling member, the tear strip will separate from the remainder of the cap along the score lines, thereby causing an opening to be formed in the cap. To assist in the opening of the container, the plastic of the cap is oriented in the direction of tearing. The score lines individually terminate on the opposing side of the cap and preventing the tear strip from being separated from the container. Once the contents have been consumed, the container may be unitarily disposed for recycling purposes.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
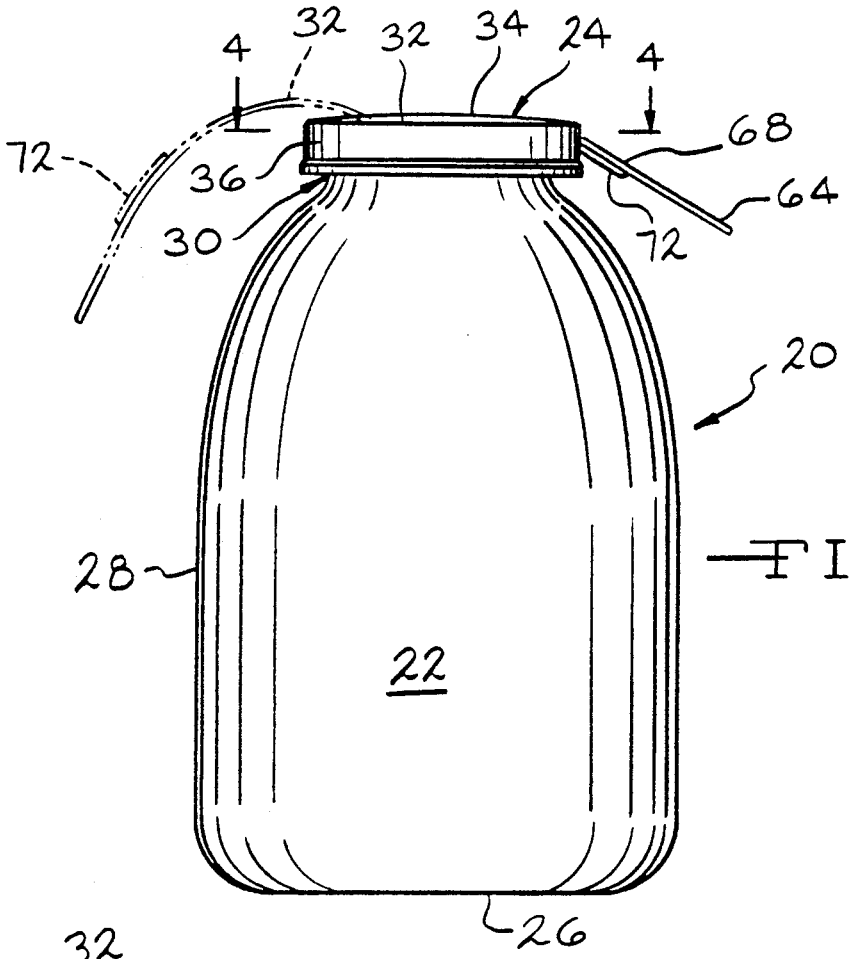
FIG. 1 is a side elevational view of a container incorporating the principals of the present invention.
Figure 2:
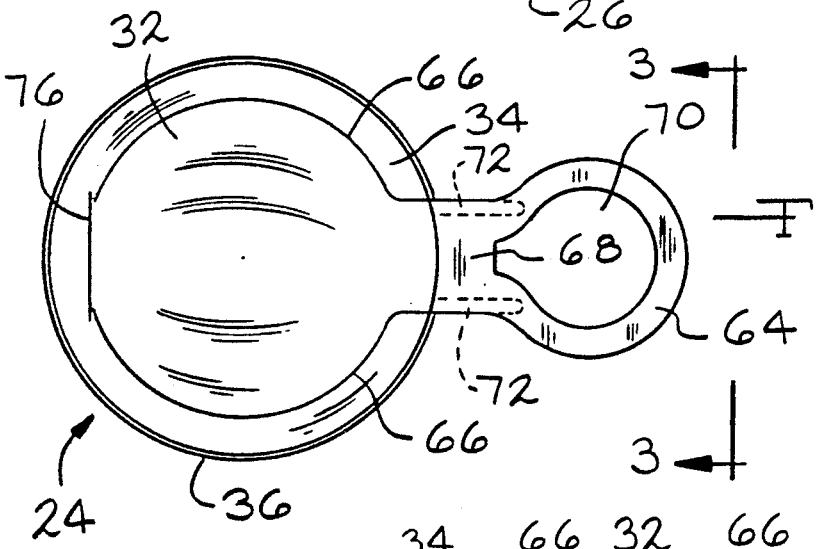
FIG. 2 is a top view of the cap employed with the container illustrated in FIG. 1.
Figure 3:
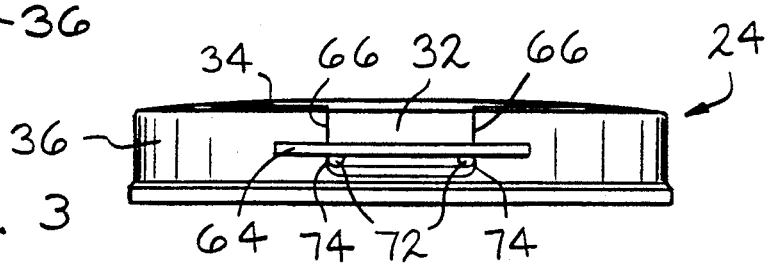
FIG. 3 is an end elevational view taken substantially along line 3—3 in FIG. 2 and showing the cap.

Now with reference to the drawing a container embodying the principles of the present invention is generally designated as 20 in FIG. 1. The container 20 generally includes a hollow body or bottle portion 22 and a closure or cap portion 24. The bottle is made up of a base 26, a side wall 28 and has a mouth 30 formed at its upper end. The cap 24 is described with more particularly below.

The container 20 of the present invention is of the single serving variety. In other words, once opened, the container 20 is not designed to be resealed. The container 20 is capable of enclosing a variety of contents. The contents might be solid foods, semi-solid foods or beverages. It is believed that the container 20 will have its greatest advantages when used with beverages.

Depending upon the type of beverage that is disposed within the container 20, the bottle 22 may be required to exhibit various structures and features. The structure of the bottle 22 might be such that the container 20 can be used in hot-fill applications, cold-fill applications or with carbonated beverages. The bottle 22 might also be formed by various techniques, including blow molding.

The particular advantage of the present invention is that the entire container 20, including both the cap 24 and the bottle 22, is constructed of a recyclable plastic material. In the preferred embodiment this material is polyethylene tarapthalate, also known as PET. The PET container 20 is advantageous and desirable because of its strength, low weight, low cost and its adaptability to various construction methods. Furthermore, all of the bottle's components may be recycled together so as to eliminate the necessity of separating various portions of the container 20. For example, typically, the cap of a PET container is discarded prior to the recycling of the bottle itself. In the present invention, since the cap 24 is also constructed of PET, the cap 24 may remain attached to the bottle during recycling.

Having overcome the problems associated with recycling the entire container 20, the present invention is designed to be a single service container 20 wherein the cap 24 remains fixed to the bottle 22 and includes a tab or tear strip 32. The tear strip 32 also remains connected to the cap 24 after opening of the container 20.

The tear strip 32 is provided in the uppermost portion or sealing member 34 of the cap 24. The size and shape of the sealing member 34 will correspond to the size and shape of the mouth 30 of the bottle 22. Generally, the shape is annular. It should be also noted that the tear strip 32 may assume various shapes and sizes, two of which are illustrated and discussed in the preferred embodiments.

Since the container 20 is for a single service, the cap 24 is not resealable. While a removable cap might be used in a container 20 embodying the principles of the present invention, it is preferred that the cap 24 itself, once engaged, is not removable from the container 20 so that complete recycling of the container 20 is ensured.

Two particular embodiments of containers 20 incorporating the principles of the present invention are particularly disclosed herein. The first embodiment is shown in FIGS. 1 through 8 and the second embodiment in FIGS. 9 through 12. Where appropriate, common features of the embodiments are designated with like references. Both embodiments will now be individually discussed.

The first embodiment, seen in FIG. 1, shows a container 20 incorporating the principles of the present invention and including a cap 24 which is fixably secured over the mouth 30 to seal the container 20. The cap 24 includes a sealing member 34 which has a shape that corresponds to the shape of the mouth 30. Extending downwardly along the outer periphery of the sealing member 34 is a skirt portion 36. The skirt 36 coacts with portions of the mouth 30 to retain the cap 24 on the bottle 22. As best seen in FIGS. 4 through 8, the interior surface of the skirt 36 is provided with four ratchet/bayonet members 38 which cooperate with corresponding ratchet/bayonet members 40 positioned equidistantly along the exterior of the mouth 30. While four are shown, the container 20 could be constructed with a greater or lesser number of ratchet/bayonet members 38 and 40.

Figure 4:
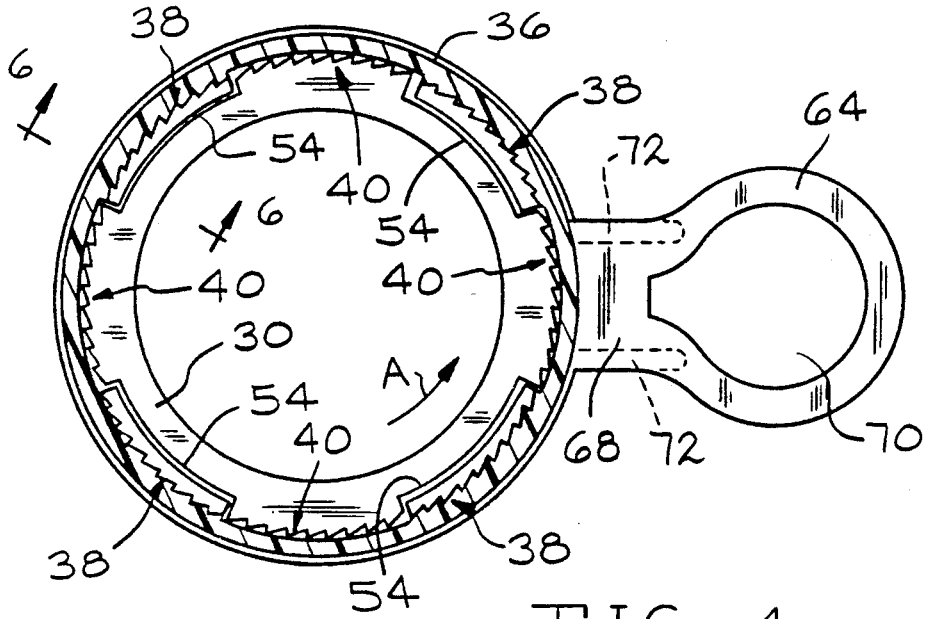
FIG. 4 is a sectional view taken substantially along line 4—4 in FIG. 1 illustrating the cap in relation to the bottle before their assembly together.
Figure 5:
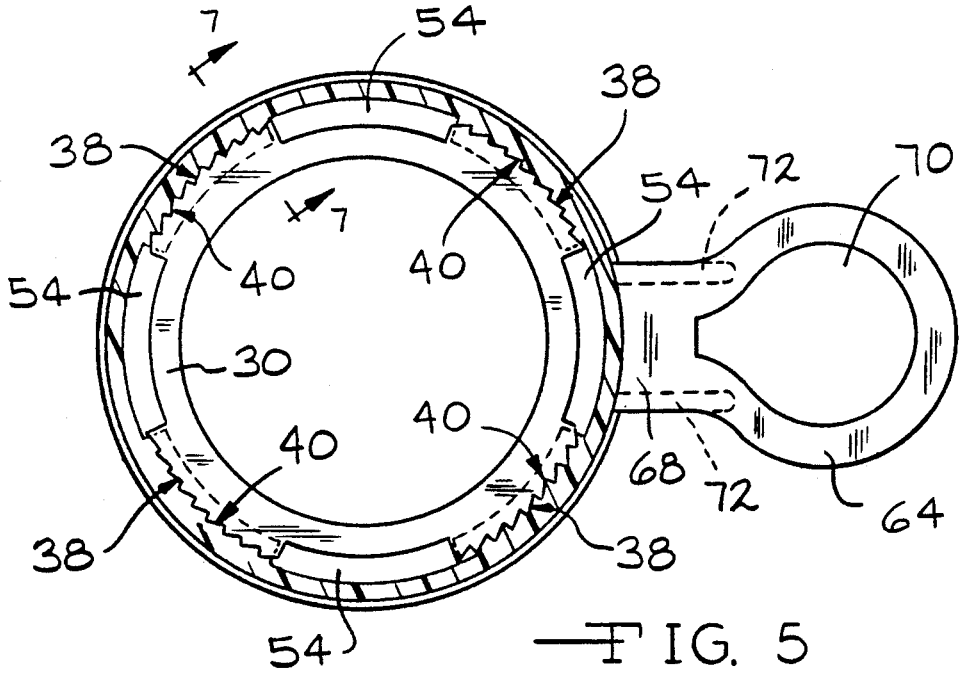
FIG. 5 is a sectional view taken substantially along the same lines as FIG. 4 and illustrates the cap and bottle in an assembled relationship.
Figure 6:
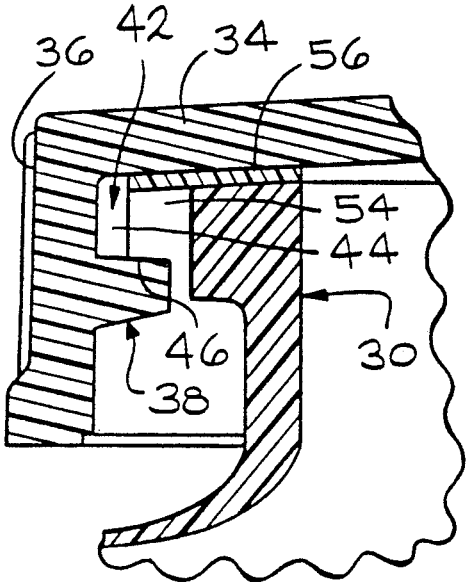
FIG. 6 is a sectional view taken substantially along line 6—6 in FIG. 4 showing a portion of the cap and bottle in an unassembled relationship.
Figure 7:
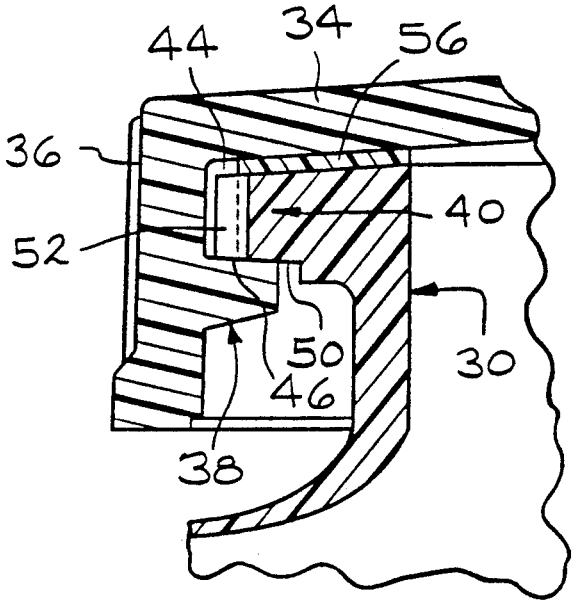
FIG. 7 is a sectional view taken substantially along line 7—7 in FIG. 5 showing a portion of the cap and bottle in an assembled relationship.
Figure 8:
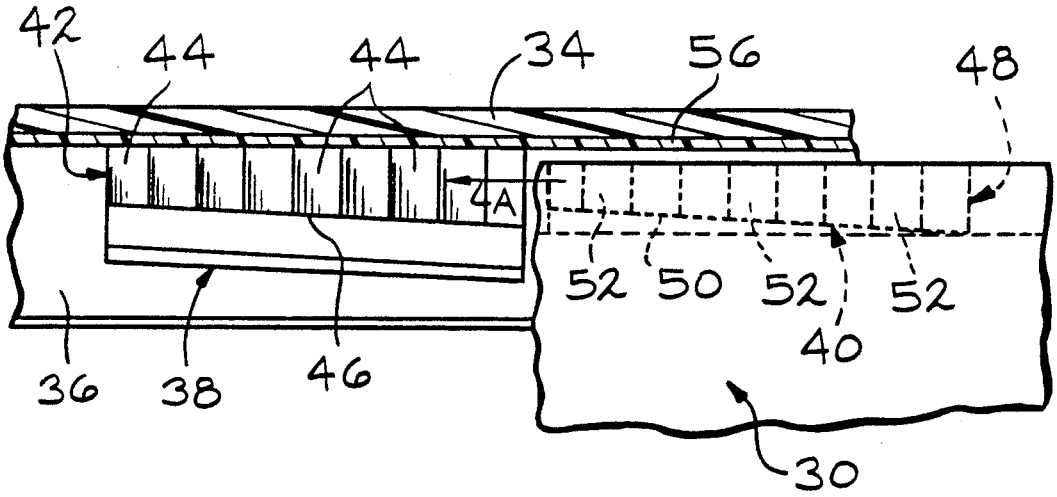
FIG. 8 is a developed view of a portion of the cap and bottle in an unassembled relationship.
Figure 9:
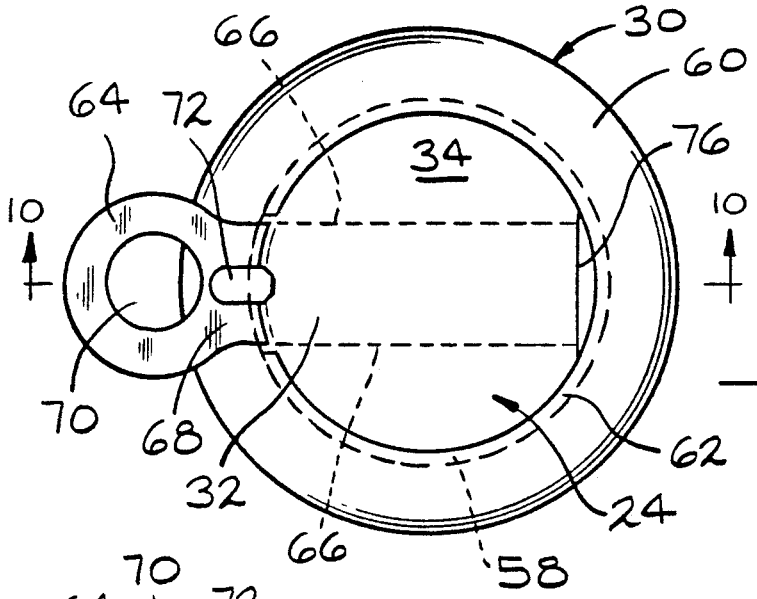
FIG. 9 is a plan view of another embodiment of a container incorporating the principles of the present invention.
Figure 10:
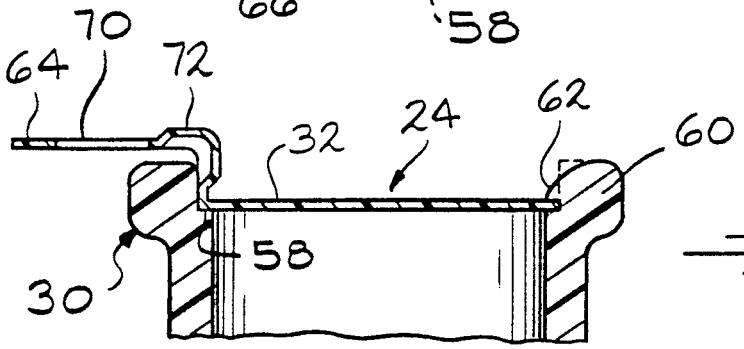
FIG. 10 is a sectional view taken substantially along line 10—10 in FIG. 9 showing the cap and bottle in assembled relationship.
Figure 11:
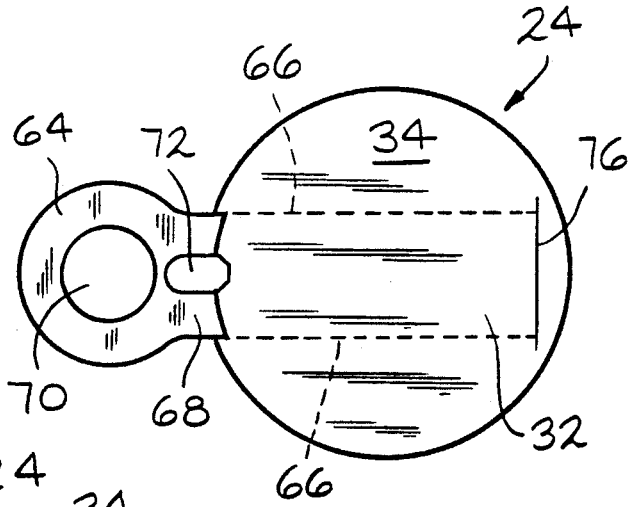
FIG. 11 is a plan view of the cap in FIG. 9 illustrating the tear strip.
Figure 12:
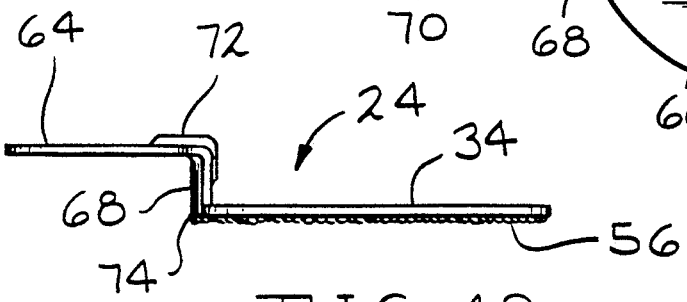
FIG. 12 is a side elevational view of the cap illustrated in FIG. 11.

As seen in FIG. 4, the ratchet/bayonet members 38 of the cap are equidistantly positioned around the interior of the skirt 36. Generally, two sections make up each ratchet/bayonet member 38 and 40, a toothed ratchet section, respectively 42 and 48, and an inclined bayonet section, respectively 46 and 50. The ratchet section 42 of the cap 24 is a row of teeth 44. (In the interest of clarity, only three of the teeth 44 are individually identified in FIG. 8.) Positioned below the ratchet section 42 is the cap bayonet section 46. As seen in FIGS. 6 and 8, the cap bayonet section 46 forms a ramped shoulder that extends further inwardly from the skirt 36 than the cap ratchet section 42 or teeth 44. Because of the ramping of the cap bayonet section 46, the row of teeth 44 will progressively vary in height from one end to the other.

Similar to the cap ratchet/bayonet members 38, the bottle ratchet/bayonet members 40 each include a ratchet section 48 and a bayonet section 50. (Again, only three are designated for clarity.) The bottle ratchet section 48 is likewise a row of teeth 52. The bottle bayonet section 50 is generally defined by the ramped lower surface of the row of teeth 52. Because of the ramped bottle bayonet section 50, the teeth 52 on the bottle 22 also exhibit progressively varying heights.

The cap 24 is placed onto the bottle 22 such that the cap's ratchet/bayonet members 38 are positioned in gaps 54 formed between adjacent bottle ratchet/bayonet members 40. (See FIGS. 4, 5 and 6.) To engage the cap 24 upon the mouth 30 of the bottle 22, the cap 24 and bottle 22 are rotated so that the bottle 22 will move in a generally counterclockwise direction, along arrow A, relative to the cap 24. During this rotation, the teeth 44 and 52 begin to successively engage one another to prevent rotation in an opposite direction. As the rotation progresses, the ramped upper surface of the cap bayonet section 46 engages the ramped lower surface of the bottle bayonet section 50. The coacting of the two bayonet sections 46 and 50 thereby pulls the interior or lowermost surface of the sealing member 34 down into engagement with the uppermost surface of the mouth 30. The ramping of the bayonet sections 46 and 50 also functions as a stop to prevent over rotation of the cap 24 relative to the bottle 22 and subsequent disengagement. This is because the larger of the teeth 52 cannot fit through the smaller openings being defined by the ramp of cap bayonet sections 46.

The interior surface of the sealing member 34 is additionally provided with a gasketing material 56. The gasketing material 56 must be either compatible with the PET or readily and easily separated therefrom for recycling purposes. Two materials satisfying these requirements are PET itself and ethylene vinyl acetate (EVA). EVA is readily separated from the PET because of its differing molecular density.

Now with reference to FIGS. 9 through 12, a second embodiment of a container 20 incorporating the principles of the present invention is discussed. In this second embodiment, the cap 24 is generally a disc member that corresponds in shape and is fixably secured to the mouth 30.

A circumferentially extending shoulder 58 is formed along the interior diameter of the opening defined by the mouth 30. The sealing member 34 is of a diameter which will allow it to sit in a resting engagement on the shoulder 58 and thereby close the opening of the mouth 30.

In order to seal the cap 24 on the mouth 30, a rim portion 60 of the mouth 30 is subjected to sonic welding or other known method for joining two plastic materials. The sonic welding is directed and limited to the strength concentration on the innermost portion of the rim 60 and causes that portion of the rim 60 to generally deform into a swage seal 62 extending around the perimeter of the sealing member 34. Upon hardening, the swage seal 62 will fixably secure the cap 24 to the bottle 22.

The surface of the sealing member 34 which engages the shoulder 58 of the mouth 30 is preferably covered with a gasketing material 56. One reason for providing the gasketing material 56 is that the sealing member 34 is only secured by the swage seal 62 approximately three hundred and ten degrees (310°) around the opening of the mouth 30. The remaining circumference is not secured by the swage seal 62 because of the attachment of a pulling member 64 to the sealing member 34. In the area of the pulling member 64, the gasketing material 56 insures the integrity of the seal.

As previously stated, both embodiments of the present invention are provided with a tear strip 32 that enables the opening of the container 20. Like the previous embodiment, the tear strip 32 is defined in the sealing member 34 by a pair of grooves or score lines 66 which extend substantially across the sealing member 34. As mentioned previously, the tear strip 32 can be numerous shapes. In the first embodiment, the tear strip 32 was displayed as a generally circular shape. The tear strip 32 of the second embodiment is generally rectangular in shape.

The score lines 66 are formed either in the upper or lower surface of the sealing member 34. Each score line 66 is generally a groove molded, coined or stamped into the surface of the sealing member 34 and represents a fault along which the tear strip 32 can be torn from the remainder of the cap 24.

In the present invention, several features are incorporated into the cap 24 to facilitate the opening of the container 20. One such feature is the previously mentioned pulling member 64. Integrally formed with the tear strip 32 and extending from a tongue 68, the pulling member 64 includes a centrally positioned finger opening 70. To provide for additional strength between the tear strip 32 and pulling member 64, a strengthening member 72, such as a rib, is provided on the connecting tongue 68.

To open the container 20, the pulling member 64 is grasped through the finger opening 70 and lifted in an upward fashion. Lifting causes the tongue 68 to bend at a sharp angle away from the tear strip 32. Once the pulling member 64 has been lifted, notches 74, formed adjacent to the tongue 68 at the end of each score lines 66, will open allowing the tear strip 32 to easily begin fracturing along the score lines 66 as further lifting and pulling occurs. To further facilitate the fracturing of the tear strip 32, the cap 24 can be thermoformed of PET that is highly molecularly oriented in a direction substantially aligned with the direction of tearing. Various methods of orienting the PET may be employed, including injection molding while controlling part geometry and extruding using known molecular orientation techniques.

Once the tear strip 32 has been fully fractured along the score lines 66, the strip 32, tongue 68 and pulling member 64 are folded over the side of the container 20 along a fold line 76 in the cap 24. The folded position is best seen in FIG. 1 and is shown in phantom. The fold line 76 is a weakened section of the sealing member 34; however, it is of sufficient strength to resist tearing during the opening of the container 20. So constructed, the tear strip 62 will remain folded in its open position while the contents of the container 20 are consumed.

From the above description, it can be seen that the tear strip 32 need not be separated or disposed of without the remainder of the container 20. This reduces the possibility of the tear strip 32 being discarded in the form of liter, as is often seen with caps from other beverage containers.

With the entire container 20 being constructed from materials compatible for recycling, essentially PET, the components of the container 20 need not be separated once sealed. Rather, the entire container 20 may be recycled in whole.

While the above description constitutes the preferred embodiments of the present invention, it will be appreciated that the invention is susceptible to modification, variation and change without departing from the proper scope and fair meaning of the accompanying claims.

What is claimed is:

1. A recyclable single service container comprising:

an upright hollow plastic body having a mouth at its upper end, a plastic tear open closure cap mounted on said body at said mouth, said closure cap having upper and lower surfaces and generally corresponding in shape to the shape of the said mouth, sealing means on said lower surface engaging said mouth to form a seal therearound and retain the contents of said hollow body therein, said closure cap being fixedly secured to said hollow body causing continual engagement of said mouth and said sealing means;

a tear strip being defined in said closure cap by two grooves and extending at least partially thereacross, said tear strip cooperating with said sealing means and said closure cap to seal said container thereby retaining the contents disposed therein; and a pulling member integrally formed with said tear strip adjacent said two grooves and extending therefrom, means for enabling gripping of said pulling member being provided thereon, a weakened area being formed at an end of said two grooves adjacent said pulling member to facilitate the tearing of said tear strip along said two grooves upon the application of a pulling force to said pulling member thereby opening said container and permitting the dispensing of the contents therefrom, said tear strip remaining attached to said closure cap after opening allowing said closure cap and container to be recycled together.

2. A single service container as set forth in claim 1 wherein said closure cap and said hollow body are formed of polyethylene terapthalate (PET).

3. A single service container as set forth in claim 2 wherein said closure cap is formed of extruded PET.

4. A single service container as set forth in claim 3 wherein said extruded PET is molecularly oriented in a direction generally corresponding to the direction of said groove.

5. A single service container as set forth in claim 2 wherein said closure cap is constructed of injection molded PET exhibiting a molecular orientation in a direction generally corresponding to the direction in which said tear strip is torn.

6. A single service container as set forth in claim 1 wherein said tear strip remains attached to said closure cap at a second weakened area, said second weakened area being formed in said closure cap between the ends of said two grooves opposite said pulling member, said second weakened area being sufficiently weak to allow said tear strip to fold thereover and being sufficiently strong to resist tearing during opening of said container.

* * * * *